US007225772B2

(12) United States Patent
Mezger et al.

(10) Patent No.: US 7,225,772 B2
(45) Date of Patent: Jun. 5, 2007

(54) METHOD, CONTROL UNIT AND PROGRAM CODE FOR A CONTROL UNIT FOR CONTROLLING A CAMSHAFT CONTROL DEVICE

(75) Inventors: Werner Mezger, Eberstadt (DE); Oliver Krannich, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/825,532

(22) Filed: Apr. 15, 2004

(65) Prior Publication Data

US 2004/0255886 A1 Dec. 23, 2004

(30) Foreign Application Priority Data

Apr. 17, 2003 (DE) ..... 103 17 652

(51) Int. Cl.
*F01L 1/34* (2006.01)

(52) U.S. Cl. ..... 123/90.15; 123/90.16; 123/90.17; 123/90.31; 701/105; 701/113; 92/5 L; 464/1; 464/2; 464/160

(58) Field of Classification Search ..... 123/90.15, 123/90.17; 701/105, 113; 92/5 L
See application file for complete search history.

(56) References Cited

U.S. PATENT DOCUMENTS

| | | | | |
|---|---|---|---|---|
| 6,330,870 | B1 * | 12/2001 | Inoue et al. | 123/90.17 |
| 6,516,763 | B1 | 2/2003 | Straus | |
| 6,758,176 | B2 * | 7/2004 | Wada et al. | 123/90.15 |
| 6,761,138 | B2 * | 7/2004 | Takahashi et al. | 123/90.15 |

FOREIGN PATENT DOCUMENTS

| | | |
|---|---|---|
| DE | 199 29 393 | 12/2000 |

* cited by examiner

*Primary Examiner*—Thomas Denion
*Assistant Examiner*—Kyle M. Riddle
(74) *Attorney, Agent, or Firm*—Kenyon & Kenyon LLP

(57) ABSTRACT

To operate a steplessly adjustable camshaft control device, particularly reliably and safely, an adaptation of the camshaft and the crankshaft is performed so that a phase angle (actual value) of the camshaft to the crankshaft is determined, the phase angle is monitored while operating the internal combustion engine and the camshaft control device is controlled as a function of a variable setpoint value so that the phase angle is equivalent to the setpoint value.

11 Claims, 3 Drawing Sheets

METHOD, CONTROL UNIT AND PROGRAM CODE FOR A CONTROL UNIT FOR CONTROLLING A CAMSHAFT CONTROL DEVICE

RELATED APPLICATION INFORMATION

This application claims the benefit of and priority to German Patent Application No. 103 17 652.7, which was filed in Germany on Apr. 17, 2003, and which is incorporated by reference.

FIELD OF THE INVENTION

The present invention relates to a method, a control unit, and a computer program for a control unit for controlling a camshaft control device.

BACKGROUND INFORMATION

German Patent Publication No. 199 29 393 refers to a method for controlling a device for varying the valve timing of an internal combustion engine, especially a camshaft control device having an hydraulically releasable starting quantity locking device. In this context, the camshaft control device is designed as a hydraulic phasing device which has a first component that is rotatably fixed to the camshaft and a second component that is in driving connection to the crankshaft. In this context, in the case of a so-called impeller advance device, the component fixed to the crankshaft is connected in a force-transmitting manner to the component fixed to the camshaft via at least one hydraulic working chamber. The at least one hydraulic working chamber is subdivided by an adjusting element inside the device into a so-called A pressure chamber and a so-called B pressure chamber. Each of these pressure chambers is connected to a controllable and/or regulatable hydraulic valve by way of a hydraulic line. The hydraulic valve, in turn, is connected to a control unit via a data line. Engine oil, for example, is used as the hydraulic fluid, which is put under pressure, during the operation of the internal combustion engine, using an oil pump, in such a way that the pressure chambers may have the oil pressure applied to them as a function of the hydraulic valves.

However, in order to obtain an oil pressure required for application to the pressure chambers, the internal combustion engine has to be operated at least at idling speed. Particularly at the start of an internal combustion engine, this is not yet sufficient for a camshaft control because the oil pressure is too low. During the start of the internal combustion engine, in order that the camshaft shall not take up an undefined position because of mechanical friction, the camshaft control device is mechanically locked for this reason in a locking position, for instance, using a retaining pin.

In this context, the retaining pin engages with a corresponding bore, as soon as the oil pressure falls below a certain value, such as during shutting off the internal combustion engine. When a minimum oil pressure is exceeded, the retaining pin is then released again from the bore. To prevent the pin from jamming, various methods of releasing it are available, such as that referred to in German Patent No. 199 29 393. In that document, the hydraulic valve is referred to as being controlled using several high frequency-timed intervals during a specified duration or using a predefinable number of intervals, in such a way that a rapid alternating pressure application on the A and B pressure chambers takes place, and consequently a jamming of the retaining pin is avoided.

During idling, the camshaft control device is operated in a reference position. In particular, in a two-step camshaft control device, the reference position is equivalent to the locking position. In steplessly controllable camshaft control devices, however, this reference position may deviate from the locking position. After a cold start of an internal combustion engine, the internal combustion engine is frequently operated at an increased idling speed. Therefore, the locking position is determined in such a way that an optimal camshaft setting is present for the start of the internal combustion engine.

In this context, it can, however, happen that a camshaft control device is locked again by mistake, during operation, for instance, because a currently required camshaft control corresponds to the locking position, and the retaining pin moves into the bore provided for locking, because of a non-stable oil pressure in this position. Additional problems may arise if the camshaft control device was not locked at the end of the preceding driving cycle, or it disengages from the locking position too early at a start.

Thus, during idling, the camshaft control device of an internal combustion engine (ICE) is operated in a reference position. In a two-step camshaft control device, the reference position is equivalent to a locking position. In steplessly controllable camshaft control devices, this reference position may deviate from the locking position. In this context, it may happen that a camshaft control device may lock itself again during the operation by mistake, the camshaft control device was not locked at the end of the previous driving cycle, or it releases itself too early from the locking position in response to a start.

SUMMARY OF THE INVENTION

It is an object of the exemplary embodiment and/or exemplary method of the present invention to provide for operating a steplessly controllable camshaft control device particularly reliably and safely.

This may be done if an adaptation of the camshaft and the crankshaft is carried out or performed in such a way that a phase angle (actual value) of the camshaft to the crankshaft is determined, the phase angle is monitored during an operation of the internal combustion engine and the camshaft control device is regulated and/or controlled as a function of a variable setpoint value in such a way that the phase angle is equivalent to the setpoint value.

The exemplary embodiment and/or exemplary method of the present invention relates to a method for controlling a camshaft control device, especially a camshaft control device for a stepless changing of valve timing in an internal combustion engine, which has a crankshaft and at least one camshaft, a phase angle of the camshaft being changed with respect to the crankshaft by using the camshaft control device.

The exemplary embodiment and/or exemplary method of the present invention also relates to a computer program which is executable on a computing element or a control unit, particularly on a microprocessor.

The exemplary embodiment and/or exemplary method of the present invention also relates to a control unit, especially a control unit in a motor vehicle, which has an arrangement for controlling a camshaft control device, particularly a stepless camshaft control device.

In response to the monitoring of the phase angle of the camshaft control device in the form of an actual value, the setpoint value is ascertained, for example, as a function of a current speed of the internal combustion engine, in the light of characteristics curves. The camshaft control device is then adjusted in such a way that the actual value corresponds to the setpoint value. This method makes possible a particularly safe operation of the camshaft control device. In addition, using this method, an error condition of the camshaft control device is particularly certainly detected, for example, in that the monitored actual value changes without this change being specified by the setpoint value.

In one advantageous refinement of the method, the camshaft control device having a locking position, the camshaft control device is operated in the locking position after the start of the internal combustion engine, until a release takes place by an engine temperature leaving a predefinable temperature range, an adaptation requirement of the phase angle is present, a predefinable time period is exceeded and/or an independent release of at least one camshaft is detected. By the definition of these release conditions it is achieved that the camshaft control device is released not only as a function of the oil pressure. Instead, when a release condition occurs, a complex control and/or regulating mechanism is started which makes it possible to control and/or regulate the camshaft control device from a defined release condition. This makes possible a particularly precise control of the camshaft control device, and consequently a particularly efficient operation of the internal combustion engine.

In an exemplary embodiment, in which the camshaft control device has a predefinable reference position, if there is no release demand and adaptation has not occurred, the camshaft control device is controlled in such a way that the camshaft control device assumes the predefinable reference position. In this context, the reference position is expediently selected so that safe operation is ensured especially when the internal combustion engine is idling. If, for example, there is not yet any information on the phase angle, because an adaptation could not yet be carried out, the camshaft control device is controlled in such a way that it assumes the reference position. This is an advantage especially when, during the start, the camshaft control device is erroneously not in the locking position.

In an exemplary method, the possibility of an independent locking of the camshaft control device is detected when an ascertained phase angle is in a predefinable locking range that surrounds the locking position, whereas a setpoint value lies outside the locking range. During the operation of an internal combustion engine, it may happen that the camshaft control device locks on its own. This independent locking may be detected or prevented using this specific embodiment. If the actual value of the phase angle is in the region of the locking position, while the setpoint value of the phase angle is outside this range, then the possibility exists of an independent locking of the camshaft control device. If the camshaft control device is not yet locked, then by purposeful control, an independent locking can be prevented.

Advantageously, in response to the recognition of a possibility of the independent locking of the camshaft control device, checking is done during a predefinable time span as to whether the actual value of the phase angle of the camshaft control device moves out of the locking range again. During this time span, if the actual value of the phase angle does not remove itself from the locking region, an independent locking is detected. The detection of an independent locking is particularly important for the secure operation of a camshaft control device, since no optimal operation of the internal combustion is possible while having a locked camshaft control device. In particular, the operation of the internal combustion engine, using a camshaft control device that is independently locked by mistake, has a negative effect on the performance and the emission behavior of the internal combustion engine.

Advantageously, upon detection of an independent locking, a releasing procedure is initiated. In order to ensure an efficient operation of the internal combustion engine, it is important to release again an independently locked camshaft control device. In this context, for example, the same control strategy and/or regulation strategy may be used as is used in releasing during the start of the internal combustion engine.

In another exemplary embodiment, checking takes place as to whether the releasing procedure has been successfully carried out. If the releasing procedure has not been successfully carried out, the releasing procedure is repeated. In view of this, for example, an error message is issued, using an appropriate control unit only when a releasing is actually no longer possible. What is avoided, consequently, is that a camshaft control device is detected as being defective although, for example, only one retaining pin used for the locking was temporarily jammed.

Implementing the exemplary embodiment and/or exemplary method of the present invention in the form of a computer program is particularly important. In this context, the computer program is executable on a computing element or a control unit, particularly on a microprocessor, and is suitable for carrying into effect the exemplary method according to the present invention. In this case, the present invention is thus implemented by the computer program, so that this computer program represents the present invention in the same manner as the method, for the execution of which the computer program is suitable. The computer program may be stored on a memory element. In particular, a random-access memory, a read-only-memory or a flash memory may be used as memory element.

The object may also be, for example, attained by a control unit of the type mentioned at the outset, in that the control unit has an arrangement for monitoring an actual value of the phase angle during an operation of the internal combustion engine, and to regulate and/or control the camshaft control device as a function of a variable setpoint value in such a way that the actual value becomes the same as the setpoint value.

DETAILED DESCRIPTION

Figure 1:
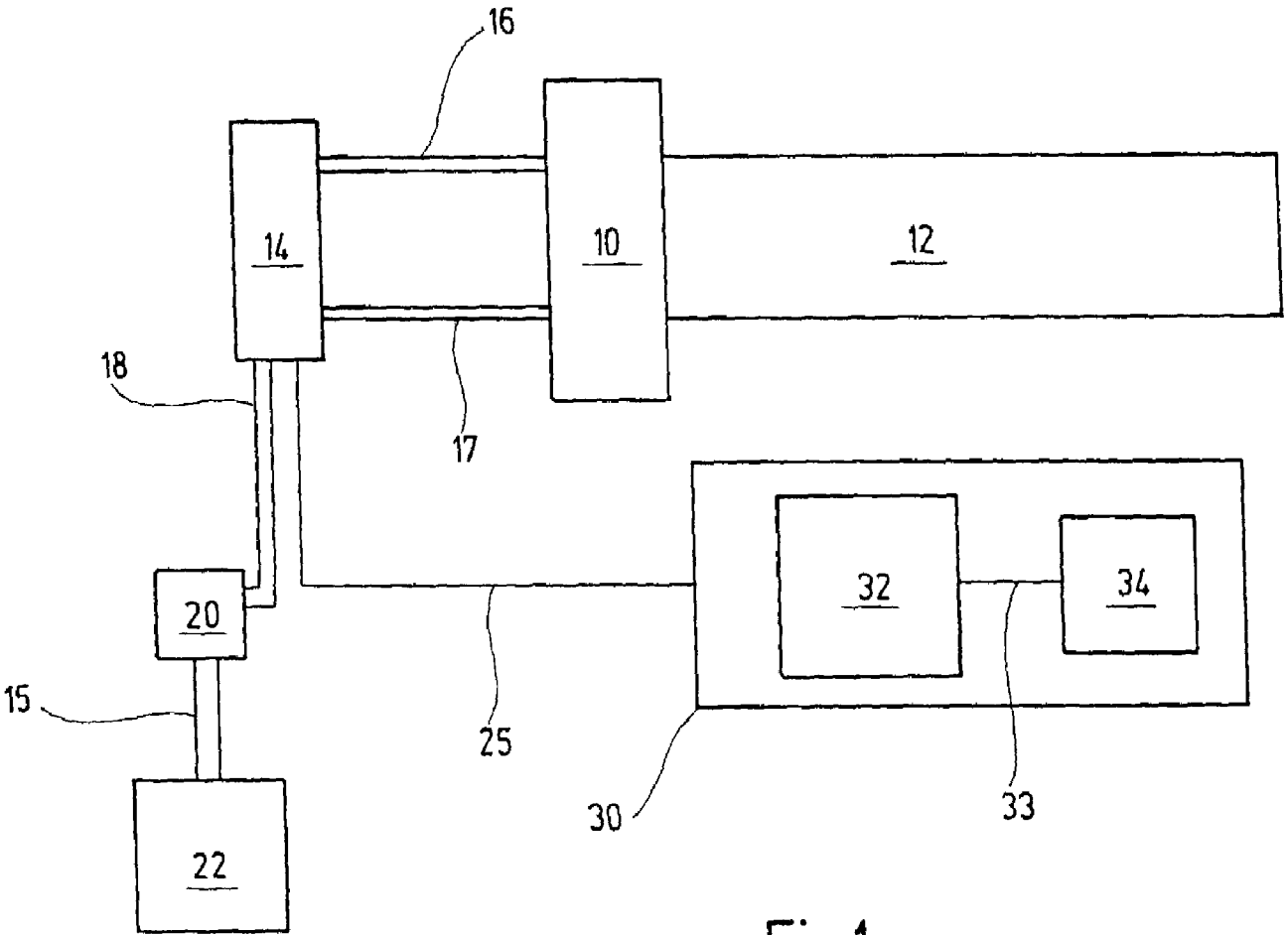
FIG. 1 shows a schematic representation of the components for controlling a camshaft control device.

In FIG. 1 components are shown that are used for controlling a camshaft control device. Camshaft control device 10 is situated on a camshaft 12. Camshaft control device 10 is connected to a hydraulic valve 14 via two pressurized media lines 14. Hydraulic valve 14 is connected to a pressure medium pump 20 via a pressurized media line 18. Pressure medium pump 20 is connected to a storage container 22 via an additional pressure media line 15. Pressure medium pump 20 may, for example, be the oil pump of the internal combustion engine, and storage container 22 may be the crankcase sump of the internal combustion engine.

Hydraulic valve 14 is connected to a control unit pump 30 via a data line 25. Control unit 30 has a microprocessor 32 and a memory element 34 connected via a bus system 33. If camshaft control device 10 is, for example, developed as an impeller advance device, it will have at least one so-called A pressure chamber and one B pressure chamber. The A and B pressure chambers are each connected to hydraulic valve 14 with the aid of pressure media lines 16 and 17. In dependence upon the pressures prevailing in these pressure chambers, a radial rotation of camshaft 12 takes place, relative to a crankshaft (not shown), which causes a change in the so-called phase angle. A change in the phase angle, in turn, causes a change in the so-called control times, i.e. the points in time of the opening and/or closing of the intake valve and the exhaust valve, controlled by the camshaft. With that, accordingly, the gas exchange, i.e. the intake in a cylinder of the gas mixture destined for combustion, and the exhaust of the combustion gases from the cylinder generated by the combustion, is able to be influenced, and thus the operation of the internal combustion engine is able to be optimized.

In order to change a phase angle, the pressures in the pressure chambers have to be changed. This takes place with the aid of hydraulic valve 14, which is controlled in a suitable manner by control unit 30.

Figure 2:
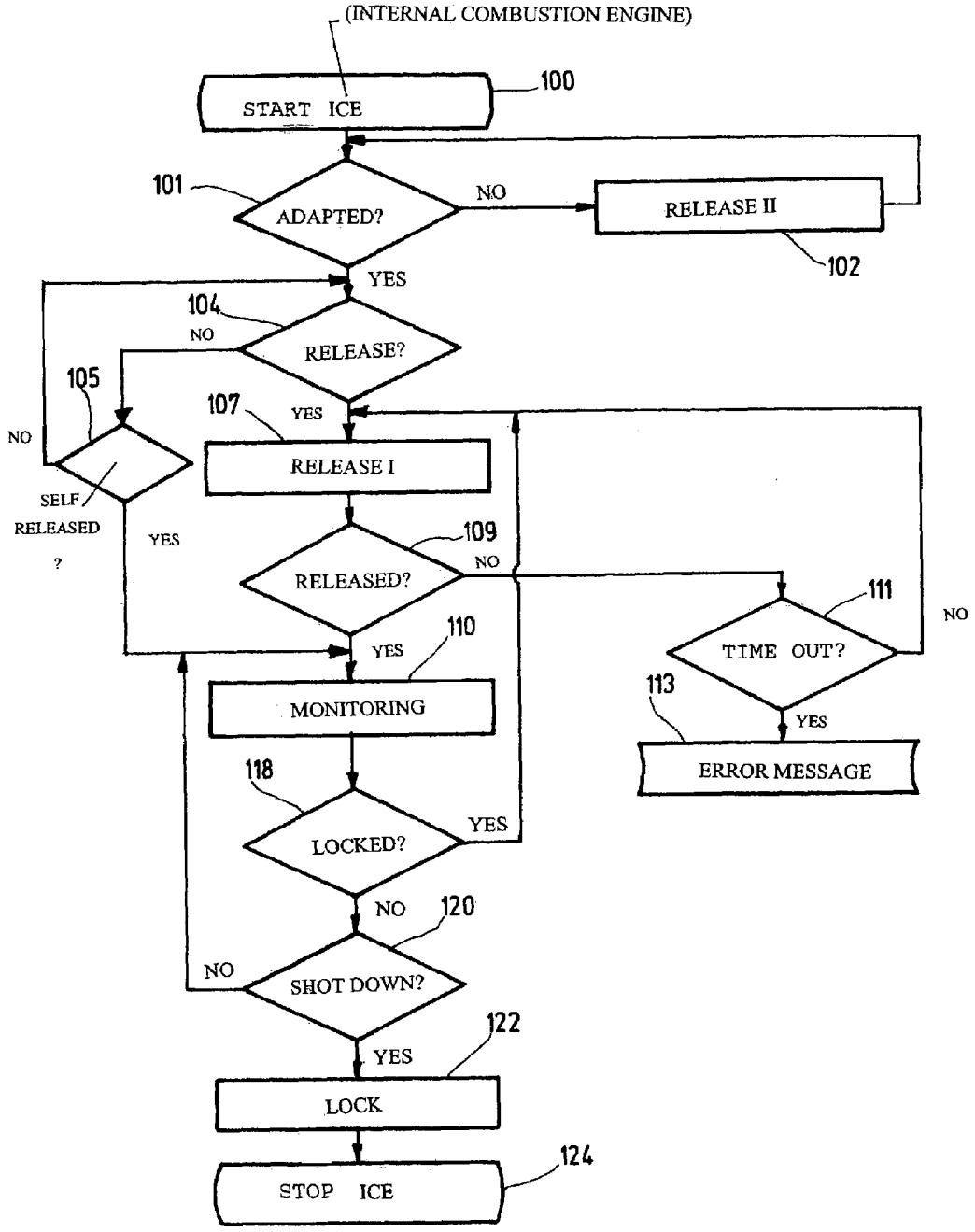
FIG. 2 shows a flow chart for controlling a camshaft control device.

FIG. 2 shows a simplified flow chart of an exemplary method according to the present invention for controlling camshaft control device 10. The method begins, for example, with a start of the internal combustion engine in a step 100. Here it is assumed that camshaft control device 10 was locked at the end of a preceding driving cycle.

In a step 101 it is tested first of all whether an adaptation of camshaft 12 to the crankshaft is present in such a way that an actual value of a phase angle of camshaft 12 with respect to the crankshaft may be ascertained.

For this purpose, for example, rotational angle sensors which record the rotational angles of the crankshaft and the camshaft are evaluated in a suitable manner. If there is no adaptation, a release function II is carried out in step 102, which takes into consideration the non-adapted state. In this release function II it is first checked whether camshaft control device 10 has already been released. Camshaft control device 10 may, for example, be already released if it has released itself independently, was not locked in response to a preceding shutting down of the internal combustion engine or release function II has already been run through. Release function II particularly provides a control of camshaft control device 10 in such a way that camshaft control device 10 assumes a so-called reference position and is held there. This reference position is selected, for example, in such a way that an operation of the internal combustion engine, that is as optimal as can be, is possible. For this, the release conditions may be taken into consideration. It is conceivable, for example, that the locking position is selected in such a way that a start optimized as to exhaust gas can take place as fast as possible, and operation of the internal combustion engine may take place in a satisfactory manner, while the reference position is selected in such a way that an operation of the internal combustion engine, that is as optimal as possible, can take place during idling. In this context, for the control of hydraulic valve 14, the control unit may, for example, access characteristics maps stored in memory element 34.

Thereupon it is checked once again in step 101 whether there is an adaptation. Steps 101 and 102 are repeated until there is adaptation.

If there is an adaptation, the system branches to a step 104 and it is checked whether a release condition of camshaft control device 10 is present. This is the case, for example, if a temperature of the internal combustion engine lies outside a predefinable temperature range, a predefinable time period has been exceeded, a demand for a camshaft control is present or a demand for a fine adaptation is present.

If the internal combustion engine has more than only one camshaft 12 that is provided with a camshaft control device, then, for example, a release may occur even if one of camshaft control devices 10 has independently released itself by mistake, during the start of the internal combustion engine. In response to an independent release of a camshaft control device 10, this camshaft control device 10 takes on an undefined condition because of mechanical friction effects, whereby no optimal combustion is possible any longer, and, in the worst case, damage may occur to camshaft control device 10. This undefined condition also has the effect of deteriorating the exhaust gas, and is noticeable, for example, by a lacking torque right up to noticeable "irregular" running of the internal combustion engine. If such an independent release appears, it is therefore expedient to put camshaft control device 10 into a defined position by control and/or regulation.

If there is a release condition present, a release function I is carried out in a step 107. Release function I differs from release function II, first of all, in that release function II is carried out when an adaptation is not yet present, whereas in release function I the assumption is made that an adjusted system is present. If an adaptation is present, a current actual value of the phase angle is always able to be evaluated by control unit 30. In the case of a locked camshaft control device 10, this actual value must be located in the region of the locking position. It is conceivable that this may be checked off using an error recognition routine. If one may conclude from the ascertained actual value of the phase angle in step 107 that camshaft control device 10 is locked, a suitable release algorithm is started, and thereby hydraulic valve 14 is controlled in such a way that the release of camshaft control device 10 is possible. Since camshaft control device 10 is typically locked mechanically using a retaining pin, one has to be particularly careful that no skewing of the retaining pin occurs during the release. For this purpose, for example, the pressure chambers of camshaft control device 10 alternately have pressure applied to them.

In a step 109, it is checked whether release function I was able to be successfully carried out and camshaft control device 10 is released. This may be recognized, for example, in that the actual value moves out of the locking region. If camshaft control device 10 has not yet been released, in a step 111 it is checked whether release function I has already been run through a predefinable number of times and whether a predefinable time period has been exceeded. If this is not the case, the method is continued in step 107, and an attempt at release is made once more. It is conceivable that, before carrying out a renewed release attempt using release function I, one may wait for a predefined time span.

However, if it is detected in step 111 that release function I was run through the predefinable number of times or that the predefinable time period has been exceeded, an error is diagnosed in a step 113, and a corresponding error routine is processed by control unit 30. This error routine may provide, in the simplest case, that an error message shall be issued.

However, if it is recognized in step 109 that camshaft control device 10 has been released, in step 110 the regular operation of camshaft control device 10 is continued. In this context, in particular, a monitoring of the phase angle takes place in that the actual value is repeatedly ascertained and compared to a predefined setpoint value. If the actual value deviates from the setpoint value, hydraulic valve 14 is controlled in such a way that camshaft control device 10 effects a change in the phase angle of camshaft 12 with respect to the crankshaft with the objective that the actual value of the phase angle corresponds to the predefined setpoint value.

A deviation of the actual value from the setpoint value of the phase angle is always determined when the predefinable setpoint value is deliberately changed, in order, for example, to react to a change of certain operating conditions, such as a current rotary speed or a torque demand on the part of the driver. The actual value is also able to deviate from the setpoint value if, during the operation of the internal combustion engine, the pressure of the hydraulic fluid, and consequently the pressure in the pressure chambers of camshaft control device 10, changes. In particular, in the case of an independently released camshaft control device 10, the actual value may deviate from the setpoint value of the phase angle. Then the activation of hydraulic valve 14 remains ineffective to the extent that the camshaft control device can no longer follow the setpoint value because of the mechanical locking. This case of the independent locking is checked in a step 118.

Independent locking may occur, for example, in that camshaft control device 10 is operated in the locking position, and the retaining pin engages with the bore provided for the locking, because of a pressure drop of the hydraulic fluid, such as of the engine oil. A camshaft control device 10 locked by mistake may then, as already described, be recognized by the comparison of the actual value to the setpoint value. If camshaft control device 10 has erroneously locked itself, the method is continued in step 107, where a release of camshaft control device 10 is initiated.

However, if, in step 118, there was not present an independent locking of camshaft control device 10, it is checked in step 120 whether a demand to shut off the internal combustion engine is present. If this is not the case, the method continues the monitoring in step 110. If in step 120 a demand to shut off is present, then in step 122, camshaft control device 10 is activated by control unit 30, with the aid of hydraulic valve 14, in such a way that locking of camshaft control device 10 takes place. In a step 124 the method ends in shutting off the internal combustion engine.

Figure 3:
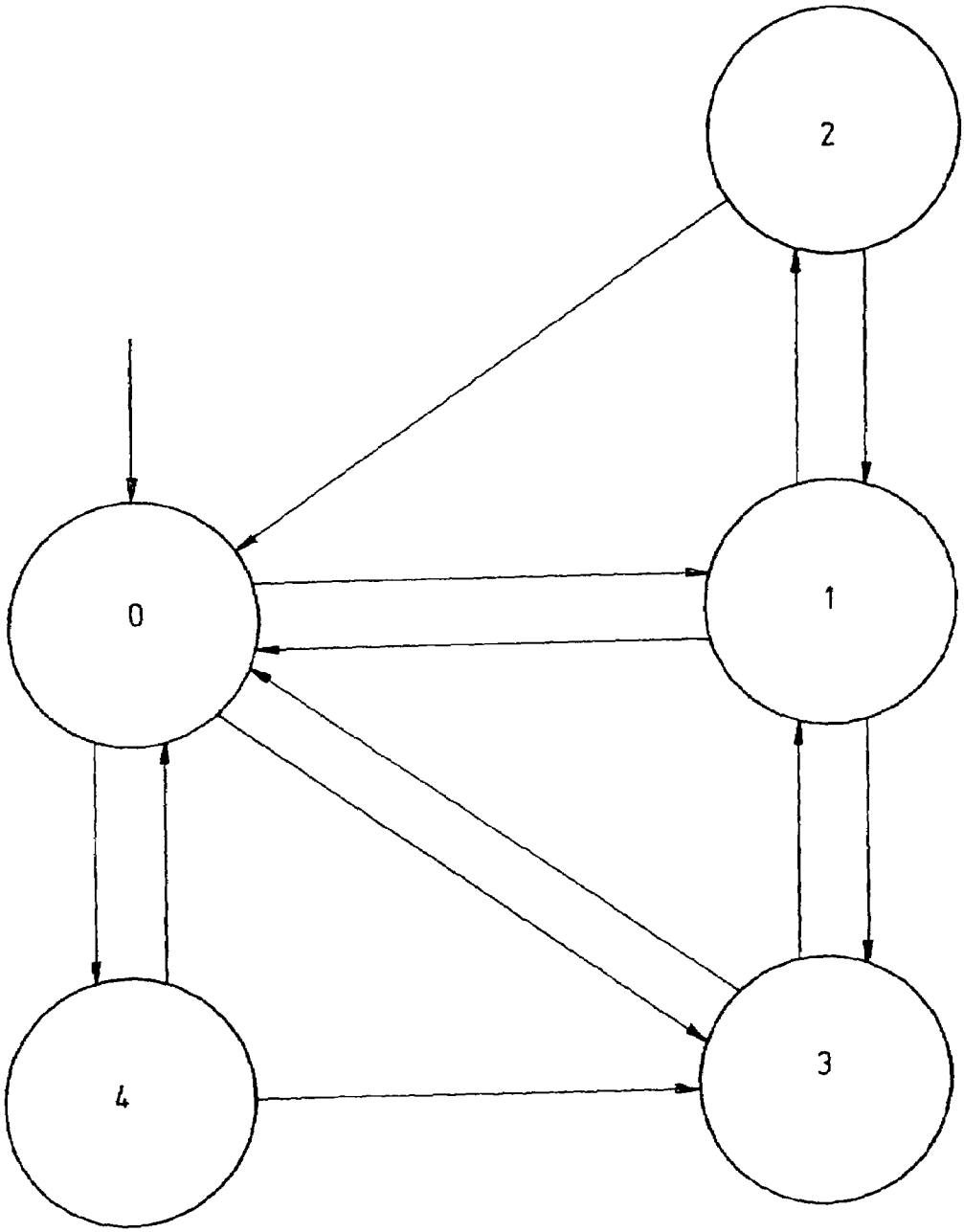
FIG. 3 shows a finite state machine (automaton) implemented by the exemplary method according to the present invention.

FIG. 3 shows a schematic representation of a finite state machine implemented by the exemplary method according to the present invention. This finite state machine may be implemented, for example in software and used in control unit 30.

At a start of the internal combustion machine, the finite state machine is in a starting state 0, in which it is assumed that camshaft control device 10 is locked. In state 0, the system waits for a release condition for release. If a release condition appears because of an adaptation demand of camshaft 12 to the crankshaft, the finite state machine changes into state 4 and it there begins a release attempt, for instance, using release function II. If there is no longer present an adaptation demand, the finite state machine changes back to state 0. However, if the release procedure in state 4 and the subsequent adaptation procedure are successful, the infinite state machine changes into state 3 and monitors the released system.

If in state 0 there is present a release condition at an adaptation that has already taken place, the finite state machine changes into state 1 and begins a release procedure, for instance, by using release function I, taking into consideration present actual values and setpoint values of the phase angle. If camshaft control device 10 was not able to be released in state 1, after a predefinable number of attempts, the finite state machine changes into state 2. There it waits a predefinable time, until it changes into state 1 again and begins once more a release attempt. However, if in state 2 a maximum waiting time has been exceeded, or if a predefinable maximum number of release attempts has already been carried out, the finite state machine changes to state 0.

If in state 1 the release attempt was successful, the finite state machine changes to state 3 and monitors the released system. In particular, it is checked in state 3 whether released camshaft control device 10 locks itself again by mistake. If such an erroneous locking is detected, the finite state machine reverts to state 1.

If in state 1, 2 or 3 the adaptation is lost, the finite state machine reverts to state 0.

Of course, in the finite state machine shown in FIG. 3, a broadening by additional states and state transitions is conceivable. For example, in an additional state, a change might occur when a turn-off command is present, and camshaft control device 10 is locked.

In the flow chart shown in FIG. 2, steps may be added, steps that are present now may be removed, or one may fit in or change sudden changes between individual steps. As an example, in the case of an adaptation that may not be possible, a diagnostic function may be started, or, during the monitoring beginning at step 110 it may also be checked to see how fast camshaft control device 10 assumes a position specified by a predefined setpoint value. From this, one may derive, for example, the wear (deterioration) of the pressure medium or of camshaft control device 10.

In the flow chart shown in FIG. 2, during the monitoring in step 110, it may be checked whether an adaptation is still present. An adaptation may be lost, for instance, if a rotational angle sensor temporarily becomes incapacitated. If the values recorded by a rotational angle sensor are transmitted to control unit 30 via a bus system or a network, such as a CAN (controller area network), even the incapacitation of the network may lead to the loss of the adaptation.

If it was detected in step 110 that no adaptation is still present, the following steps may be carried out or performed:

In a step 201 (not shown in FIG. 2) the attempt is made to obtain a new adaptation of camshaft 12 to the crankshaft, and thereby an ascertainment of the phase angle. In this context, it would be advantageous if, during this adaptation phase, control unit 30 causes camshaft control device 10 to be operated in the reference position by an activation of hydraulic valve 14. If the adaptation in step 201 cannot take place within a specified time period, this is detected in a step 202 (also not shown in FIG. 2), and the system branches to step 113, in which an appropriate error treatment is carried out.

If the adaptation in step 201 is successfully carried out, the system branches to step 118, in which, as was described above, the method is continued in that it is checked whether camshaft control device 10 has independently locked itself by mistake.

What is claimed is:

1. A method for controlling a camshaft control device in a start-up operation of an internal combustion engine, the camshaft control device being for steplessly changing valve timing in the internal combustion engine which has a crankshaft and at least one camshaft, a phase angle of the camshaft being changeable with respect to the crankshaft by the camshaft control device, the camshaft control device including a locking position, the method comprising:

determining, in the start-up operation of the internal combustion engine, whether there is an adaptation of the camshaft to the crankshaft so that the phase angle of the camshaft with respect to the crankshaft may be determined;

monitoring the phase angle during an operation of the internal combustion engine; and controlling the camshaft control device as a function of a variable setpoint value so that the phase angle is equivalent to the setpoint value;

wherein, when there is no release command and the adaptation has not occurred and the camshaft control device is not in the locking position in the start-up operation of the internal combustion engine, the camshaft control device is activated so that the camshaft control device assumes a predefinable reference position that is different from the locking position, and wherein the reference position is selected in such a way that an idling operation of the internal combustion engine is enabled, and wherein the setpoint value is purposefully controlled in such a way that the camshaft control device lies outside the locking position to prevent an independent locking.

2. The method of claim 1, wherein the camshaft control device is operated in the locking position after a start of the internal combustion engine, until at least one of the following is satisfied: (i) a release takes place by an engine temperature leaving a predefinable temperature range; (ii) an adaptation requirement of the setpoint value of the phase angle is present; (iii) a predefinable time period is exceeded; and (iv) an independent release of at least one of the at least one camshaft is detected.

3. The method of claim 1, wherein a possibility of an independent locking of the camshaft control device is detected if an ascertained phase angle is in a predefinable locking range that surrounds the locking position, and the setpoint value lies outside the locking range.

4. The method of claim 3, wherein in response to a detection of a possibility of an independent locking of the camshaft control device, during a predefinable time span checking as to whether an actual value of the phase angle of the camshaft control device is moved out of the locking range again and, during this time span, if the actual value of the phase angle does not remove itself from the locking region, the independent locking is detected.

5. The method of claim 1, further comprising:

initiating, as a function of an unlocking demand, an unlocking procedure for unlocking the camshaft control device; and initiating a release procedure upon detecting an independent locking.

6. The method of claim 5, further comprising:

checking whether the release procedure has been successfully performed; and repeating the release procedure if the release procedure was not successful.

7. The method according to claim 1, wherein the locking position is selected such that the start-up operation of the internal combustion engine, optimized with respect to the exhaust gas, is performed as quickly as possible.

8. A computer program that is executable on a control arrangement to control a camshaft control device in a start-up operation of an internal combustion engine, the camshaft control device being for steplessly changing valve timing in the internal combustion engine which has a crankshaft and at least one camshaft, a phase angle of the camshaft being changeable with respect to the crankshaft by the camshaft control device, the camshaft control device including a locking position, the controlling being done by performing the following:

determining, in the start-up operation of the internal combustion engine, whether there is an adaptation of the camshaft to the crankshaft so that the phase angle of the camshaft with respect to the crankshaft may be determined;

monitoring the phase angle during an operation of the internal combustion engine; and controlling the camshaft control device as a function of a variable setpoint value so that the phase angle is equivalent to the setpoint value;

wherein, when there is no release command and the adaptation has not occurred and the camshaft control device is not in the locking position in the start-up operation of the internal combustion engine, the camshaft control device is activated so that the camshaft control device assumes a predefinable reference position that is different from the locking position, and wherein the computer program is run on a microprocessor of the control arrangement, and wherein the setpoint value is purposefully controlled in such a way that the camshaft control device lies outside the locking position to prevent an independent locking.

9. The computer program of claim 8, wherein the computer program is stored at one of a memory element, a random-access memory (RAM), a read-only memory (ROM), and a flash memory.

10. A control unit for controlling a lockable, stepless camshaft control device in a start-up operation of an internal combustion engine, the camshaft control device being for steplessly changing valve timing in the internal combustion engine which has a crankshaft and at least one camshaft, a phase angle of the camshaft being changeable with respect to the crankshaft by the camshaft control device, the camshaft control device including a locking position, the method comprising:

a determining arrangement to determine, in the start-up operation of the internal combustion engine, whether there is an adaptation of the camshaft to the crankshaft so that the phase angle of the camshaft with respect to the crankshaft may be determined;

a monitoring arrangement to monitor the phase angle during an operation of the internal combustion engine; and a controlling arrangement to control the camshaft control device as a function of a variable setpoint value so that the phase angle becomes equal to the setpoint value;

wherein, when there is no release command and the adaptation has not occurred and the camshaft control device is not in the locking position in the start-up operation of the internal combustion engine, the camshaft control device is activated so that the camshaft control device assumes a predefinable reference position that is different from the locking position, and wherein the setpoint value is purposefully controlled in such a way that the camshaft control device lies outside the locking position to prevent an independent locking.

11. The control unit of claim 10, further comprising:

an initiating arrangement to initiate a release procedure to release the camshaft control device as a function of at least one release demand;

a checking arrangement to check whether the release procedure was successfully performed; and a repeating arrangement to repeat the release procedure in response to a detected, unsuccessful release procedure.

* * * * *